US011208610B2

(12) United States Patent
Aoki et al.

(10) Patent No.: US 11,208,610 B2
(45) Date of Patent: Dec. 28, 2021

(54) LUBRICANT OIL COMPOSITION

(71) Applicant: IDEMITSU KOSAN CO., LTD., Chiyoda-ku (JP)

(72) Inventors: Shinji Aoki, Sodegaura (JP); Hidenori Torii, Kisarazu (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/071,688

(22) PCT Filed: Jan. 16, 2017

(86) PCT No.: PCT/JP2017/001274

§ 371 (c)(1),
(2) Date: Jul. 20, 2018

(87) PCT Pub. No.: WO2017/130777

PCT Pub. Date: Aug. 3, 2017

(65) Prior Publication Data

US 2019/0024008 A1 Jan. 24, 2019

(30) Foreign Application Priority Data

Jan. 26, 2016 (JP) ..... JP2016-012593

(51) Int. Cl.

| | |
|---|---|
| ***C10M 137/04*** | (2006.01) |
| ***C10M 133/12*** | (2006.01) |
| ***C10M 169/04*** | (2006.01) |
| ***C10M 101/02*** | (2006.01) |
| ***C10N 20/02*** | (2006.01) |
| ***C10N 30/04*** | (2006.01) |
| ***C10N 30/08*** | (2006.01) |
| ***C10N 30/10*** | (2006.01) |
| ***C10N 30/00*** | (2006.01) |
| ***C10N 40/08*** | (2006.01) |
| ***C10N 40/12*** | (2006.01) |
| ***C10N 40/30*** | (2006.01) |
| ***C10N 40/00*** | (2006.01) |

(52) U.S. Cl.

CPC ..... *C10M 137/04* (2013.01); *C10M 101/02* (2013.01); *C10M 133/12* (2013.01); *C10M 169/04* (2013.01); *C10M 2203/1006* (2013.01); *C10M 2207/288* (2013.01); *C10M 2209/084* (2013.01); *C10M 2215/064* (2013.01); *C10M 2215/065* (2013.01); *C10M 2215/223* (2013.01); *C10M 2223/04* (2013.01); *C10N 2020/02* (2013.01); *C10N 2030/04* (2013.01); *C10N 2030/08* (2013.01); *C10N 2030/10* (2013.01); *C10N 2030/40* (2020.05); *C10N 2030/43* (2020.05); *C10N 2040/08* (2013.01); *C10N 2040/12* (2013.01); *C10N 2040/135* (2020.05); *C10N 2040/30* (2013.01)

(58) Field of Classification Search

CPC ..... C10M 137/04; C10M 2215/064; C10M 2215/065; C10M 101/02; C10M 133/12; C10M 169/04; C10M 2203/1006; C10M 2207/288; C10M 2209/084; C10M 2215/223; C10N 2020/02; C10N 2030/04; C10N 2030/08; C10N 2030/10; C10N 2030/40; C10N 2030/43; C10N 2040/12; C10N 2040/135; C10N 2040/30

See application file for complete search history.

(56) References Cited

U.S. PATENT DOCUMENTS

| | | | | |
|---|---|---|---|---|
| 6,165,951 | A | 12/2000 | Leonhardt | |
| 2008/0274925 | A1 * | 11/2008 | Aebli | C08K 5/18 508/563 |
| 2010/0093568 | A1 | 4/2010 | Tagawa et al. | |
| 2015/0051126 | A1 | 2/2015 | Sato | |

FOREIGN PATENT DOCUMENTS

| | | | | |
|---|---|---|---|---|
| CN | 1938260 | | 3/2007 | |
| EP | 2055763 | A1 * | 5/2009 | C10M 133/00 |
| JP | 7-252489 | A | 10/1995 | |
| JP | 2002-528559 | A | 9/2002 | |

(Continued)

OTHER PUBLICATIONS

International Search Report dated Feb. 28, 2017 in PCT/JP2017/001274 filed Jan. 16, 2017.

Extended European Search Report dated Jul. 9, 2019 in European Patent Application No. 17744008.8.

Office Action issued in ID Application No. PID201805503, dated Mar. 18, 2020.

Office Action in corresponding Chinese Patent Application No. 201780007926.5, dated Mar. 18, 2021. (w/English Translation).

* cited by examiner

*Primary Examiner* — James C Goloboy

(74) *Attorney, Agent, or Firm* — Oblon, McClelland, Maier & Neustadt, L.L.P.

(57) ABSTRACT

Provided is a lubricating oil composition containing a base oil (A) and an amine-based antioxidant (B), wherein the component (B) contains a phenyl-naphthylamine (B1), an alkylphenyl-naphthylamine (B2) and a di(alkylphenyl)amine (B3), the content of the component (B1) is 2.0 to 10.0% by mass relative to 100% by mass of the total amount of the component (B), the content of the component (B2) is 40.0 to 90.0% by mass relative to 100% by mass of the total amount of the component (B), and the content of the component (B3) is 8.0 to 50.0% by mass relative to 100% by mass of the total amount of the component (B). The lubricating oil composition maintains excellent oxidation stability even in long-term use in high-temperature environments, and has an excellent lifetime and is excellent also in a sludge preventing effect.

12 Claims, No Drawings

(56) References Cited

FOREIGN PATENT DOCUMENTS

| | | | |
|---|---|---|---|
| JP | 2005-239897 | A | 9/2005 |
| JP | 2008-13687 | A | 1/2008 |
| JP | 2014-515058 | A | 6/2014 |
| WO | WO 2013/146805 | A1 | 10/2013 |

LUBRICANT OIL COMPOSITION

TECHNICAL FIELD

The present invention relates to a lubricating oil composition.

BACKGROUND ART

A lubricating oil composition for use in instruments, such as turbines, e.g., steam turbines and gas turbines, as well as rotary gas compressors, hydraulic equipments and others is used while circulated in a high-temperature environment system for a long period of time.

When the lubricating oil composition for use in these instruments is used in a high-temperature environment, the antioxidation performance thereof may gradually lower, and in many cases, long-term use thereof is often difficult. Consequently, a lubricating oil composition capable of maintaining oxidation stability even in long-term use in a high-temperature environment and having an excellent lifetime is desired.

Various developments have been made for lubricating oil compositions having improved oxidation stability and favorable for use for turbines, rotary gas compressors, hydraulic equipments, etc.

For example, PTL 1 discloses a lubricant composition for industrial use, which contains a base oil, an aromatic amine-based antioxidant, and a dithiocarbamate-based anti-wear agent, and in which each content of the aromatic amine-based antioxidant and the dithiocarbamate-based anti-wear agent and the total content thereof each are controlled to fall within a specific range.

PTL 2 discloses a lubricant composition containing an unsubstituted phenyl-naphthylamine and a di(alkylphenyl) amine in combination as an antioxidant, and further containing a thiophosphate as an anti-wear agent.

In the lubricant compositions described in PTLs 1 and 2, an aromatic amine-based antioxidant as an antioxidant is combined with a sulfur atom-containing compound as an anti-wear agent to attain a synergistic effect of improving antioxidation performance.

Further, PTL 3 discloses a lubricating oil composition containing an alkylphenyl-naphthylamine and a di(alkylphenyl)amine as an antioxidant, and further containing a phosphorus-based extreme-pressure agent.

CITATION LIST

Patent Literature

PTL 1: JP 2014-515058 A
PTL 2: JP 2002-528559 A
PTL 3: JP 2005-239897 A

SUMMARY OF INVENTION

Technical Problem

However, the lubricating oil compositions disclosed in PTLs 1 to 3 still have room for improvement in point of preventing degradation of oxidation stability to thereby improve the lifetime of the lubricating oil composition in long-term use in high-temperature environments.

In particular, the present inventors' investigation have revealed that the lubricating oil composition described in PTL 3 is insufficient in point of preventing oxidation degradation in high-temperature environments and is problematic in point of lifetime.

In addition, a lubricating oil composition for use in turbines, rotary gas compressors, hydraulic equipments and the like is required to have an effect of preventing sludge formation accompanied by use thereof. In particular, long-term use in high-temperature environments is said to be an environment for easy sludge formation.

The formed sludge adheres to, for example, a bearing of a rotor to generate heat, thereby providing a risk of bearing damage, or may clog a filter arranged in a circulation line, or may deposit on a control valve, thereby often causing control system operation failures, etc.

The present inventors' investigation have revealed that the lubricating oil compositions described in PTLs 1 to 3 are insufficient in point of the effect of preventing sludge formation in long-term use in high-temperature environments.

In particular, the lubricant compositions described in PTLs 1 and 2 contain a sulfur atom-containing compound such as dithiocarbamate or thiophosphate, but the presence of the sulfur atom-containing compound is a significant cause for sludge formation.

Consequently, the lubricating oil compositions described in PTLs 1 to 3 are problematic in point of lifetime prolongation by maintaining oxidation stability and in point of an effect of sludge prevention, in long-term use in high-temperature environments, and are required to be further improved.

An object of the present invention is to provide a lubricating oil composition capable of maintaining excellent oxidation stability even in long-term use in high-temperature environments to have an excellent lifetime and excellent also in a sludge prevention effect.

Solution to Problem

The present inventors have found that a lubricating oil composition which uses three kinds of amine-based antioxidants in combination and in which each content thereof is controlled to fall within a specific range can solve the above-mentioned problems, and have completed the present invention.

Specifically, the present invention provides the following [1].

[1] A lubricating oil composition containing a base oil (A) and an amine-based antioxidant (B), wherein:

the component (B) contains a phenyl-naphthylamine (B1), an alkylphenyl-naphthylamine (B2) and a di(alkylphenyl)amine (B3), the content of the component (B1) is from 2.0 to 10.0% by mass relative to 100% by mass of the total amount of the component (B), the content of the component (B2) is from 40.0 to 90.0% by mass relative to 100% by mass of the total amount of the component (B), and the content of the component (B3) is from 8.0 to 50.0% by mass relative to 100% by mass of the total amount of the component (B).

Advantageous Effects of Invention

The lubricating oil composition of the present invention maintains excellent oxidation stability even in long-term use in high-temperature environments and has an excellent lifetime, and is excellent also in a sludge prevention effect.

DESCRIPTION OF EMBODIMENTS

In this description, "kinematic viscosity" and "viscosity index" are values measured according to JIS K2283.

Also in this description, the definition of "a lubricating oil composition not substantially containing a component X" is to exclude "a lubricating oil composition obtained by intentionally blending a component X from a specific motive", and the lubricating oil composition may contain a trace of a component X that may be contained as an impurity.

[Lubricating Oil Composition]

The lubricating oil composition of the present invention contains a base oil (A) and an amine-based antioxidant (B) containing a phenyl-naphthylamine (B1), an alkylphenyl-naphthylamine (B2) and a di(alkylphenyl)amine (B3).

The lubricating oil composition of one embodiment of the present invention may further contain any other antioxidant (C) than the component (B) within a range not detracting from the advantageous effects of the present invention, and may contain any other additives for a lubricating oil than antioxidants.

In the lubricating oil composition of one embodiment of the present invention, the total content of the component (A) and the component (B) is preferably 70 to 100% by mass based on the total amount (100% by mass) of the lubricating oil composition, more preferably 80 to 100% by mass, even more preferably 90 to 100% by mass, further more preferably 95 to 100% by mass.

Each component contained in the lubricating oil composition of one embodiment of the present invention is described below.

<Base Oil (A)>

The base oil (A) for use in the present invention may be any of a mineral oil and a synthetic oil, and may also be a mixed oil of a mineral oil and a synthetic oil.

Examples of mineral oils include topped crudes obtained through atmospheric distillation of crude oils such as paraffin-based mineral oils, intermediate-based mineral oils and naphthene-based mineral oils; distillates obtained through reduced-pressure distillation of such topped crudes; mineral oils obtained by purifying the distillates through one or more purification treatments of solvent deasphalting, solvent extraction, hydrocracking, solvent dewaxing, catalytic dewaxing or hydrorefining; and mineral oil waxes obtained by isomerizing a wax produced through Fischer-Tropsch synthesis (GTL wax (Gas To Liquids WAX)).

One of these mineral oils may be used singly, or two or more thereof may be used in combination.

Among these, as the mineral oils for use in the present invention, mineral oils grouped in Group 2 or Group 3 in the base oil category by API (American Petroleum Institute), and mineral oils obtained through isomerization of GTL wax are preferred; and mineral oils grouped in Group 3 and mineral oils obtained through isomerization of GTL wax are more preferred.

Examples of synthetic oils include poly-α-olefins such as α-olefin homopolymers, or α-olefin copolymers (for example, $C_{8-14}$α-olefin copolymers such as ethylene-α-olefin copolymers); isoparaffin; various esters such as polyol esters, dibasic acid esters (for example, ditridecyl glutarate), tribasic acid esters (for example, 2-ethylhexyl trimellitate) and phosphate esters; various ethers such as polyphenyl ethers; polyalkylene glycols; alkylbenzenes; alkylnaphthalenes; and synthetic oils obtained by isomerization of wax produced through Fischer-Tropsch synthesis (GTL wax).

One of these synthetic oils may be used singly or two or more thereof may be used in combination.

Among these, poly-α-olefins are preferred for the synthetic oil for use in the present invention.

The kinematic viscosity at 40° C. of the base oil (A) is preferably 10 to 200 $mm^2/s$, more preferably 20 to 100 $mm^2/s$, even more preferably 25 to 80 $mm^2/s$, from the viewpoint of lubricating performance, cooling performance and reduction in friction loss in stirring.

The viscosity index of the base oil (A) is preferably 60 or more, more preferably 75 or more, even more preferably 90 or more, from the viewpoint of suppressing viscosity change with temperature change.

In the case where a mixed oil of two or more kinds selected from mineral oils and synthetic oils is used as the base oil (A), the kinematic viscosity at 40° C. and the viscosity index of the mixed oil each may fall within the above-mentioned range.

In the lubricating oil composition of one embodiment of the present invention, the content of the base oil (A) is preferably 60% by mass or more based on the total amount (100% by mass) of the lubricating oil composition, more preferably 65% by mass or more, even more preferably 70% by mass or more, further more preferably 75% by mass or more, especially preferably 80% by mass or more, and is preferably 99.99% by mass or less, more preferably 99.90% by mass or less.

<Amine-Based Antioxidant (B)>

The amine-based antioxidant (B) for use in the present invention contains a phenyl-naphthylamine (B1), an alkylphenyl-naphthylamine (B2) and a di(alkylphenyl)amine (B3).

Even when used singly, the component (B1) and the component (B3) may contribute toward improving oxidation stability, but could hardly express oxidation stability required for a lubricating oil composition that is expected to be used for a long period of time in high-temperature environments such as turbines, rotary gas compressors, hydraulic equipments, etc.

Accordingly, the present inventors have found that, when the component (B1) and the component (B3) are used in combination each in a predetermined amount, a lubricating oil composition can express higher oxidation stability applicable even to use for a long period of time in high-temperature environments and can have a more prolonged lifetime than ever before.

However, it has been found that the lubricating oil composition containing the component (B1) and the component (B3) often precipitates sludge in long-term use in high-temperature environments and is therefore problematic in point of prevention of sludge formation. In particular, when the content of the component (B1) increases in the lubricating oil composition, it has been found that the effect of preventing sludge formation tends to lower.

For solving the problems, the present inventors have found that, when the component (B2) is additionally used as the amine-based antioxidant (B), then sludge precipitation to occur in use can be prevented.

The lubricating oil composition of the present invention has been made based on the above-mentioned findings.

The content of the component (B1) is 2.0 to 10.0% by mass relative to 100% by mass of the total amount of the component (B), preferably 2.5 to 9.0% by mass, more preferably 3.0 to 8.0% by mass, even more preferably 3.2 to 7.0% by mass, and further more preferably 3.5 to 6.5% by mass.

The lubricating oil composition in which the content of the component (B1) is less than 2.0% by mass readily undergoes oxidation degradation in long-term use in high-temperature environments, and is problematic in point of lifetime.

On the other hand, the lubricating oil composition in which the content of the component (B1) is more than 10.0% by mass readily precipitates sludge to form in long-term use in high-temperature environments.

The content of the component (B2) is 40.0 to 90.0% by mass relative to 100% by mass of the total amount of the component (B), preferably 46.0 to 88.5% by mass, more preferably 50.0 to 87.0% by mass, even more preferably 53.0 to 85.5% by mass, and further more preferably 55.5 to 84.0% by mass.

The lubricating oil composition in which the content of the component (B2) is less than 40.0% by mass readily precipitates sludge to form in long-term use in high-temperature environments.

On the other hand, the lubricating oil composition in which the content of the component (B2) is more than 90.0% by mass could not sufficiently secure the content of the component (B1) and the component (B3), and therefore readily undergoes oxidation degradation in long-term use in high-temperature environments, and is problematic in point of lifetime.

The content of the component (B3) is 8.0 to 50.0% by mass relative to 100% by mass of the total amount of the component (B), preferably 9.0 to 45.0% by mass, more preferably 10.0 to 42.0% by mass, even more preferably 11.3 to 40.0% by mass, and further more preferably 12.5 to 38.0% by mass.

The lubricating oil composition in which the content of the component (B3) is less than 8.0% by mass readily undergoes oxidation degradation in long-term use in high-temperature environments, and is problematic in point of lifetime.

On the other hand, the lubricating oil composition in which the content of the component (B3) is more than 50.0% by mass readily precipitates sludge to form in long-term use in high-temperature environments. In addition, the oxidation stability thereof may be insufficient to cause reduction in lifetime.

In the lubricating oil composition of one embodiment of the present invention the content of the component (B1) is preferably 2.5 to 20 parts by mass relative to 100 parts by mass of the total amount of the component (B2), more preferably 3.0 to 15 parts by mass, even more preferably 3.5 to 12 parts by mass, and further more preferably 4.0 to 10 parts by mass, from the above-mentioned viewpoints.

In the lubricating oil composition of one embodiment of the present invention, from the above-mentioned viewpoints, the content of the component (B3) is preferably 9 to 90 parts by mass relative to 100 parts by mass of the total amount of the component (B2), more preferably 10 to 80 parts by mass, even more preferably 12 to 70 parts by mass, and further more preferably 14 to 65 parts by mass.

The phenyl-naphthylamine (B1) is an amine having an unsubstituted phenyl group and an unsubstituted naphthyl group, and is a compound differing from the component (B2) in that the phenyl group therein does not have a substituent.

Specifically, the component (B1) includes phenyl-α-naphthylamine, and phenyl-3-naphthylamine.

In one embodiment of the present invention, the component (B1) is preferably a compound (B11) represented by the following general formula (b1-1) (phenyl-α-naphthylamine).

(b1-1)

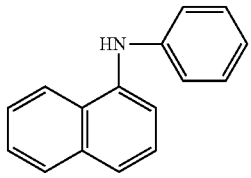

The alkylphenyl-naphthylamine (B2) is an amine having a phenyl group substituted with an alkyl group and an unsubstituted naphthyl group.

In one embodiment of the present invention, the component (B2) includes a compounds (B20) represented by the following general formula (b2-0), and is preferably a compound (B21) represented by the following general formula (b2-1), more preferably a compound (B22) represented by the following general formula (b2-2).

(b2-0)

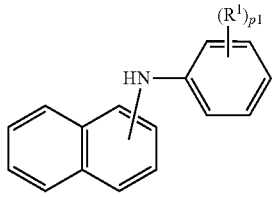

(b2-1)

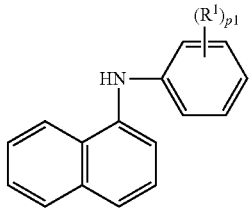

(b2-2)

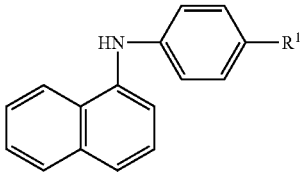

In the above-mentioned general formulae (b2-0), (b2-1) and (b2-2), $R^1$ each independently represents an alkyl group.

In the general formulae (b2-0) and (b2-1), p1 represents an integer of 1 to 5, and is preferably an integer of 1 to 3, more preferably an integer of 1 to 2, even more preferably 1.

In the general formulae (b2-0) and (b2-1), plural $R^1$'s, if any, may be the same as each other or may be different from each other.

The carbon number of the alkyl group that may be selected for $R^1$ is generally 1 to 30, but is preferably 1 to 20, more preferably 4 to 16, even more preferably 6 to 14, from the viewpoint of improving solubility in base oil and improving the effect of preventing sludge precipitation to occur in long-term use in high-temperature environments.

The di(alkylphenyl)amine (B3) is an amine having two phenyl groups each substituted with an alkyl group.

In one embodiment of the present invention, the component (B3) is preferably a compound (B31) represented by the following general formula (b3-1), more preferably a compound (B32) represented by the following general formula (b3-2).

(b3-1)

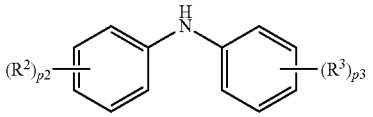

(b3-2)

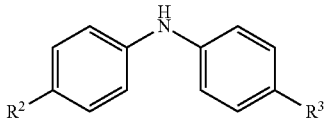

In the above-mentioned general formulae (b3-1) and (b3-2), $R^2$ and $R^3$ each independently represent an alkyl group.

In the general formula (b3-1), p2 and p3 each independently represent an integer of 1 to 5, preferably an integer of 1 to 3, more preferably an integer of 1 to 2, and even more preferably 1.

In the formula (b3-1), plural $R^2$'s, if any, may be the same as each other or may be different from each other. Similarly, plural $R^3$'s, if any, may be the same as each other or may be different from each other.

The carbon number of the alkyl group that may be selected for $R^2$ and $R^3$ is each independently generally 1 to 30, preferably 1 to 20, more preferably 4 to 16, even more preferably 4 to 14, from the viewpoint of improving solubility in base oil.

Specific examples of the alkyl group that may be selected for $R^1$, $R^2$ and $R^3$ include a methyl group, an ethyl group, various propyl groups, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl group, various tricosyl groups, various tetracosyl groups, various pentacosyl groups, various hexacosyl groups, various heptacosyl groups, various octacosyl groups, various nonacosyl groups, various triacontyl groups, various hentriacontyl groups, various dotriacontyl groups, various tritriacontyl groups, various tetratriacontyl groups, various pentatriacontyl groups, various hexatriacontyl groups, various heptatriacontyl groups, various octatriacontyl groups, various nonatriacontyl groups, and various tetracontyl groups.

Here, the above-mentioned term "various" is a term used as a meaning to indicate all isomers of the target alkyl group.

The alkyl group may be a linear alkyl group, or may be a branched alkyl group.

In the lubricating oil composition of one embodiment of the present invention, preferably, the component (B1) is the compound (B11) represented by the general formula (b1-1), the component (B2) is the compound (B21) represented by the general formula (b2-1), and the component (B3) is the compound (B31) represented by the general formula (b3-1).

In the lubricating oil composition of a more preferred embodiment of the present invention, more preferably, the component (B1) is the compound (B11) represented by the general formula (b1-1), the component (B2) is the compound (B22) represented by the general formula (b2-2), and the component (B3) is the compound (B32) represented by the general formula (b3-2).

The component (B) may contain any other amine-based antioxidant than the components (B1) to (B3).

Examples of such other amine-based antioxidants than the components (B1) to (B3) include amine compounds of the general formula (b2-1) where the naphthalene ring is substituted with the above-mentioned alkyl group, and amine compounds of the general formula (b3-1) where p2 or p3 are 0, compounds represented by the following general formula (b-4).

$$R^A—NH—R^B \quad \text{(b-4)}$$

In the formula, $R^A$ and $R^B$ each independently represent an aryl group having 12 to 18 ring carbon atoms and optionally substituted with an alkyl group, at least one of $R^A$ and $R^B$ is an aryl group having 12 to 18 ring carbon atoms and substituted with an alkyl group.

The alkyl group includes the above-mentioned ones that may be selected for $R^1$ to $R^3$.

Examples of the aryl group include a biphenyl group, a terphenyl group, an anthryl group, and a fluorenyl group.

In the lubricating oil composition of one embodiment of the present invention, the total content of the components (B1) to (B3) in the component (B) is preferably 80 to 100% by mass based on the total amount (100% by mass) of the component (B) contained in the lubricating oil composition, more preferably 90 to 100% by mass, even more preferably 95 to 100% by mass, and further more preferably 98 to 100% by mass.

In the lubricating oil composition of one embodiment of the present invention, the content of the component (B) is preferably 0.01 to 10% by mass based on the total amount (100% by mass) of the lubricating oil composition, more preferably 0.10 to 7.0% by mass, even more preferably 0.20 to 5.0% by mass, further more preferably 0.25 to 2.0% by mass, and especially preferably 0.30 to 1.0% by mass.

<Antioxidant (C) Except for Component (B)>

The lubricating oil composition of one embodiment of the present invention may contain any other antioxidant (C) than the component (B).

Examples of the antioxidant (C) include phenol-based antioxidants and phosphorus-based antioxidants; and phenol-based antioxidants are preferred.

Examples of the phenol-based antioxidants include monocyclic phenol compounds such as 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl)phenol, 2,6-di-t-amyl-4-methylphenol, and n-octadecyl-3-(3,5-di-t-butyl-4-hydroxyphenyl)propionate; polycyclic phenol compounds such as 4,4'-methylenebis(2,6-di-t-butylphenol), 4,4'-isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

The content of the antioxidant (C) except for the component (B) is preferably 0 to 100 parts by mass relative to 100 parts by mass of the total amount of the component (B) contained in the lubricating oil composition, more preferably 0 to 70 parts by mass, even more preferably 0 to 50 parts by mass, and further more preferably 0 to 30 parts by mass.

In the lubricating oil composition of one embodiment of the present invention, from the viewpoint of preventing sludge precipitation to occur in long-term use in high temperature environments, the content of the metal-based antioxidant is preferably as small as possible, and more preferably, the composition does not substantially contain a metal-based antioxidant.

Examples of the metal-based antioxidant include zinc-containing antioxidants such as zinc dialkyldithiophosphates.

In the lubricating oil composition of one embodiment of the present invention, the content of the metal-based antioxidant is preferably less than 10 parts by mass relative to 100 parts by mass of the total amount of the component (B) in the lubricating oil composition, more preferably less than 5 parts by mass, even more preferably less than 1 part by mass, and further more preferably less than 0.1 parts by mass.

In the lubricating oil composition of one embodiment of the present invention, from the viewpoint of preventing sludge precipitation to occur in long-term use in high-temperature environments, the content of the sulfur atom-containing compound such as a sulfur-based antioxidant is preferably as small as possible, and more preferably, the composition does not substantially contain a sulfur atom-containing compound.

The "sulfur atom-containing compound" as referred to herein indicates not only the sulfur-based antioxidant but also any other sulfur atom-containing compound that is blended as an additive for a lubricating oil such as an anti-wear agent.

In the lubricating oil composition of one embodiment of the present invention, the content of the sulfur atom-containing compound is preferably less than 10 parts by mass relative to 100 parts by mass of the total amount of the component (B) in the lubricating oil composition, more preferably less than 5 parts by mass, even more preferably less than 1 part by mass, and further more preferably less than 0.1 parts by mass.

<Additive for Lubricating Oil>

The lubricating oil composition of one embodiment of the present invention may contain any other additive for lubricating oil than antioxidant, within a range not detracting from the advantageous effects of the present invention.

Examples of the additive for lubricating oil include an extreme-pressure agent, a detergent dispersant, a viscosity index improver, a rust inhibitor, a metal deactivator, an anti-foaming agent, a friction modifier, and an anti-wear agent.

One of these additives for lubricating oil may be used singly or two or more thereof may be used in combination.

In this description, additives such as a viscosity index improver and an anti-foaming agent is, as the case may be, blended with any other component in the form of a solution dissolved in a diluent oil such as a mineral oil, a synthetic oil or a light gas oil, in consideration of the handleability or the solubility thereof in the base oil (A). In such a case, in this description, the content of the additive such as an anti-foaming agent or a viscosity index improver is a content in terms of the active ingredient (resin-equivalent content) excluding diluent oil.

Hereinunder the details of the additives for a lubricating oil are described.

(Extreme-Pressure Agent)

Examples of the extreme-pressure agent include phosphorus-based extreme-pressure agents such as phosphate esters, phosphite esters, acidic phosphate esters and acidic phosphite esters; halogen-based extreme-pressure agents such as chlorohydrocarbons; and organic metal-based extreme pressure agents.

Among these, preferably, the extreme-pressure agent for use in one embodiment of the present invention contains a phosphorus-based extreme-pressure agent and more preferably an extreme-pressure agent of phosphate esters.

One of such extreme-pressure agents may be used singly or two or more thereof may be used in combination.

The phosphorus-based extreme-pressure agent for use in one embodiment of the present invention is preferably a phosphate ester (1) represented by the following general formula (p-1), more preferably a phosphate ester (2) represented by the following general formula (p-2).

(p-1)

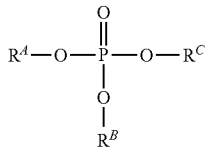

(p-2)

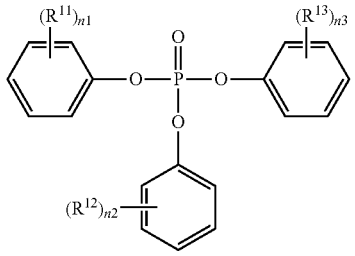

In the above general formula (p-1), $R^A$ to $R^C$ each independently represent an alkyl group or a substituted or unsubstituted aryl group.

The carbon number of the alkyl group that may be selected for $R^A$ to $R^C$ is preferably 4 to 30, more preferably 4 to 20, even more preferably 4 to 16, and further more preferably 4 to 12.

The ring carbon number of the aryl group that may be selected for $R^A$ to $R^C$ is preferably 6 to 18, more preferably 6 to 12.

The aryl group that may be selected for $R^A$ to $R^C$ may have a substituent, and the substituent includes an alkyl group having 1 to 20 (preferably 1 to 10, more preferably 1 to 6, even more preferably 1 to 3) carbon atoms In the above general formula (p-2), $R^{11}$ to $R^{13}$ each independently represent an alkyl group.

n1, n2 and n3 each independently represent an integer of 0 to 5, and is preferably an integer of 0 to 2, more preferably an integer of 0 to 1.

The carbon number of the alkyl group that may be selected for $R^{11}$ to $R^{13}$ is preferably 1 to 20, more preferably 1 to 10, even more preferably 1 to 6, and further more preferably 1 to 3.

Examples of the phosphate esters (1) or (2) represented by the above general formula (p-1) or (p-2) for use as an extreme-pressure agent include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, and xylenyldiphenyl phosphate.

In the case where the lubricating oil composition of one embodiment of the present invention contains an extreme-pressure agent, the content of the extreme-pressure agent is preferably 0.01 to 10% by mass based on the total amount (100% by mass) of the lubricating oil composition, more preferably 0.05 to 5% by mass, even more preferably 0.10 to 2.5% by mass.

In the case where the lubricating oil composition of one embodiment of the present invention contains an extreme-pressure agent, the content of a phosphorus-based extreme-pressure agent is preferably 0.01 to 10% by mass based on the total amount (100% by mass) of the lubricating oil composition, more preferably 0.05 to 5% by mass, even more preferably 0.10 to 2.5% by mass.

Relative to total amount (100% by mass) of the extreme-pressure agent contained in the lubricating oil composition of one embodiment of the present invention, the content of the phosphate ester (1) represented by the above general formula (p-1) is preferably 70 to 100% by mass, more preferably 80 to 100% by mass, even more preferably 90 to 100% by mass, and further more preferably 95 to 100% by mass.

Relative to total amount (100% by mass) of the extreme-pressure agent contained in the lubricating oil composition of one embodiment of the present invention, the content of the phosphate ester (2) represented by the above general formula (p-2) is preferably 70 to 100% by mass, more preferably 80 to 100% by mass, even more preferably 90 to 100% by mass, and further more preferably 95 to 100% by mass.

Relative to total amount, 100 parts by mass of the amine-based antioxidant (B) in the lubricating oil composition of one embodiment of the present invention, the content ratio of the phosphorus-based extreme-pressure agent is preferably 10 to 150 parts by mass, more preferably 20 to 100 parts by mass, even more preferably 25 to 90 parts by mass, and further more preferably 30 to 85 parts by mass.

(Detergent Dispersant)

Examples of the detergent dispersant include metal sulfonates, metal salicylates, metal phenates, organic phosphite esters, organic phosphate esters, organic metal phosphates, succinimides, benzylamines, succinates, and polyalcohol esters.

The metal constituting the metal salt such as a metal sulfonate is preferably an alkali metal or an alkaline earth metal, more preferably sodium, calcium, magnesium or barium, and even more preferably calcium.

Succinimides, benzylamines and succinates may be boron-modified ones.

In the case where the lubricating oil composition of one embodiment of the present invention contains a detergent dispersant, the content of the detergent dispersant is preferably 0.01 to 10% by mass based on the total amount (100% by mass) of the lubricating oil composition, more preferably 0.02 to 7% by mass, even more preferably 0.03 to 5% by mass.

(Viscosity Index Improver)

Examples of the viscosity index improver include non-dispersant-type polymethacrylates, dispersant-type polymethacrylates, olefin-based copolymers (for example, ethylene-propylene copolymers), dispersant-type olefin-based copolymers, and styrene-based copolymers (for example, styrene-diene copolymers, and styrene-isoprene copolymers).

In the case where the lubricating oil composition of one embodiment of the present invention contains a viscosity index improver, the content of the viscosity index improver (the amount of active component) is preferably 0.01 to 10% by mass based on the total amount (100% by mass) of the lubricating oil composition, more preferably 0.02 to 7% by mass, even more preferably 0.03 to 5% by mass.

(Rust Inhibitor)

Examples of the rust inhibitor include metal sulfonates, alkylbenzene sulfonates, dinonylnaphthalene sulfonates, organic phosphite esters, organic phosphate esters, organic metal sulfonates, organic metal phosphates, alkenylsuccinates, and polyalcohol esters.

In the case where the lubricating oil composition of one embodiment of the present invention contains a rust inhibitor, the content of the rust inhibitor is preferably 0.01 to 10.0% by mass based on the total amount (100% by mass) of the lubricating oil composition, more preferably 0.03 to 5.0% by mass.

(Metal Deactivator)

The metal deactivator includes benzotriazole compounds, tolyltriazole compounds, thiadiazole compounds, imidazole compounds, and pyrimidine compounds.

In the case where the lubricating oil composition of one embodiment of the present invention contains a metal deactivator, the content of the deactivator is preferably 0.01 to 5.0% by mass based on the total amount (10% by mass) of the lubricating oil composition, more preferably 0.15 to 3.0% by mass.

(Anti-Foaming Agent)

Examples of the anti-foaming agent include silicone-based anti-foaming agents, fluorine-based anti-foaming agents such as fluorosilicone oils and fluoroalkyl ethers, and polyacrylate-based anti-foaming agents.

In the case where the lubricating oil composition of one embodiment of the present invention contains an anti-foaming agent, the content of the anti-foaming agent (the amount of active component) is preferably 0.001 to 0.50% by mass based on the total amount (100% by mass) of the lubricating oil composition, more preferably 0.01 to 0.30% by mass.

(Friction Modifier)

Examples of the friction modifier include molybdenum-based friction modifiers such as molybdenum dithiocarbamate (MoDTC), and molybdenum dithiophosphate (MoDTP); and ash-free friction modifiers such as aliphatic amines, fatty acid esters, fatty acids, aliphatic alcohols, and aliphatic ethers having at least one alkyl group or alkenyl group with 6 to 30 carbon atoms in the molecule.

In the case where the lubricating oil composition of one embodiment of the present invention contains a friction modifier, the content of the friction modifier is preferably 0.01 to 5.0% by mass based on the total amount (100% by mass) of the lubricating oil composition.

As described above, from the viewpoint of suppressing sludge precipitation to occur in long-term use in high-temperature environments, preferably, a sulfur atom-containing friction modifier such as MoDTC or MoDTP is not substantially contained.

(Anti-Wear Agent)

Examples of the anti-wear agent include phosphorus-containing compounds such as phosphite eaters, phosphate esters, phosphonate esters, and amine salts or metal salts thereof.

In the case where the lubricating oil composition of one embodiment of the present invention contains an anti-wear agent, the content of the anti-wear agent is preferably 0.01 to 5.0% by mass based on the total amount (100% by mass) of the lubricating oil composition.

[Production Method for Lubricating Oil Composition]

The lubricating oil composition of the present invention may be produced by blending a base oil (A), and an amine-based antioxidant (B) containing a phenyl-naphthylamine (B1), an alkylphenyl-naphthylamine (B2) and a di(alkylphenyl)amine (B3).

At that time, if desired, an antioxidant (C) and the above-mentioned lubricative additive may be blended.

The blending amount of the components (B1) to (B3) is an amount that is so controlled that the content of each component could fall within the above-mentioned range based on the total amount of the resultant lubricating oil composition, and the same shall apply to the other components.

After the components have been blended, preferably, these are stirred and uniformly dispersed.

[Various Properties of Lubricating Oil Composition]

The kinematic viscosity at 40° C. of the lubricating oil composition of one embodiment of the present invention is preferably 5 to 300 $mm^2/s$, more preferably 10 to 200 $mm^2/s$, even more preferably 15 to 100 $mm^2/s$.

The viscosity index of lubricating oil composition of one embodiment of the present invention is preferably 85 or more, more preferably 90 or more, even more preferably 95 or more.

When the lubricating oil composition of one embodiment of the present invention is tested according to the rotating pressure vessel oxidation test (RPVOT) of JIS K 2514-3, at a test temperature of 150° C. and under a pressure before heating of 620 kPa, the time to be taken until the pressure lowers from the maximum pressure by 175 kPa (RPVOT value) is preferably 1800 minutes or more, more preferably 2000 minutes or more, even more preferably 2200 minutes or more, and further more preferably 2400 minutes or more.

When the the lubricating oil composition of one embodiment of the present invention is tested according to the oxidation stability test (Dry-TOST method) of ASTM D7873, the time to be taken until the residual percentage of RPVOT value measured according to ASTM D2272 reaches less than 25% is preferably 192 hours or more.

The "residual percentage of RPVOT value" is a value calculated according to the following equation.

[Residual percentage of RPVOT value]=[RPVOT value after a predetermined time]/[RPVOT value before the test]×100

The "time to be taken until the residual percentage of RPVOT value reaches less than 25%" is an index to indicate the lifetime of a lubricating oil composition, and a longer time means a lubricating oil composition having a longer lifetime.

When the the lubricating oil composition of one embodiment of the present invention is tested according to the oxidation stability test (Dry-TOST method) of ASTM D7873, the sludge formation amount after 192 hours from the start of the test is preferably less than 2.0 mg/100 ml, more preferably less than 1.5 mg/100 ml, even more preferably less than 1.3 mg/100 ml.

The sludge formation amount is a value measured through a membrane filter having a mean pore size of 1.0 m, according to ASTM D7873.

[Use of Lubricating Oil Composition, Lubrication Method]

The lubricating oil composition of one embodiment of the present invention can be used as turbine oils for use for lubrication of various turbines such as steam turbines, nuclear turbines, gas turbines, and hydroelectric turbines; bearing oils, gear oils or control system operating oils for use for lubrication of various turbomachines such as blowers or compressors; and further hydraulic oils, lubricating oils for internal combustion engines, etc.

Namely, the lubricating oil composition of the present invention is preferably used for lubrication of various turbines, various turbomachines, hydraulic equipments, etc.

Accordingly, the present invention can also provide a lubrication method mentioned below.

Lubrication Method of the Present Invention:

A lubrication method using a lubricating oil composition containing a base oil (A) and an amine-based antioxidant (B) containing a phenyl-naphthylamine (B1), an alkylphenyl-naphthylamine (B2) and a di(alkylphenyl)amine (B3), wherein, relative to 100% by mass of the total amount of the component (B), the content of the component (B1) is 2.0 to 10.0% by mass, the content of the component (B2) is 40.0 to 90.0% by mass, and the content of the component (B3) is 8.0 to 50.0% by mass.

EXAMPLES

Next, the present invention is described more specifically with reference to Examples, but the present invention is not limited to these Examples.

[Measurement Methods of Various Physical Data]

(1) Kinematic Viscosity

According to JIS K2283, kinematic viscosity at different temperatures was measured.

(2) Viscosity Index

Measured according to JIS K2283.

Examples 1 to 2, Comparative Examples 1 to 11

The base oil, the amine-based antioxidant and various additives shown below were blended in the blending ratio shown in Table 1 and Table 2, and fully mixed to prepare lubricating oil compositions (X1) to (X2) and (Y1) to (Y11). The details of the base oil, the amine-based antioxidant and various additives used are as mentioned below.

(Base Oil)

"Base oil (A)": mineral oil having a kinematic viscosity at 40° C. of 31.31 to 31.68 $mm^2/s$, and a viscosity index of 124.

(Amine-Based Antioxidant)

"Component (B1)": phenyl-α-naphthylamine, corresponding to the compound (B11) represented by the general formula (b1-1).

"Component (B2)-i": p-octylphenyl-α-naphthylamine, corresponding to the compound (B22) represented by the general formula (b2-2) where $R^1$ is an octyl group.

"Component (B2)-ii": p-dodecylphenyl-α-naphthylamine, corresponding to the compound (B22) represented by the general formula (b2-2) where $R^1$ is a dodecyl group.

"Component (B3)-i": 4-octylphenyl-4-butylphenylamine, corresponding to the compound (B32) represented by the general formula (b3-2) where one of $R^2$ and $R^3$ is an octyl group and the other is a butyl group.

"Component (B3)-ii": di(p-octylphenyl)amine, corresponding to the compound (B32) represented by the general formula (b3-2) where $R^2$ and $R^3$ are both an octyl group.

(Various Additives)

"Extreme-pressure agent": tricresyl phosphate.

"Rust inhibitor": alkenylsuccinic acid half ester.

"Copper deactivator": benzotriazole compound.

"Anti-foaming agent": polymethacrylate diluent oil having a resin concentration of 3% by mass.

Shown in Table 1 and Table 2, various physical data of each of the prepared lubricating oil compositions (X1) to (X2) and (Y1) to (Y11) were measured according to the above-mentioned methods, and, in addition, according to the test method mentioned below, the oxidation stability of the lubricating oil compositions was evaluated. These results are shown in Table 1 and Table 2.

(1) Rotating Pressure Vessel Oxidation Test (RPVOT)

According to the rotating pressure vessel oxidation test (RPVOT) of JIS K 2514-3, each lubricating oil composition was tested at a test temperature of 150° C. and under a pressure before heating of 620 kPa, and the time taken until the pressure lowered from the maximum pressure by 175 kPa (initial RPVOT value) was measured. A longer time means that the tested lubricating oil composition is excellent in oxidation stability.

(2) Oxidation Stability Test (Dry-TOST)

According to the oxidation stability test (Dry-TOST method) of ASTM D7873, the sludge formation amount and the RPVOT value according to ASTM D2272 after 168 hours, 192 hours and 216 hours at 150° C. were respectively measured.

The sludge formation amount was measured using a membrane filter available from Merck Millipore Corporation having a mean pore size of 1.0 μm according to ASTM D7873.

From the RPVOT value after each time, the residual percentage of RPVOT value was calculated according to the following equation.

[Residual percentage of RPVOT value]=[RPVOT value after a predetermined time]/[initial RPVOT value]×100

In this test, the RPVOT value and the sludge formation amount were measured after 168 hours, 192 hours and 216 hours in that order, and at the time when the "residual percentage of RPVOT value" reached less than 25%, the test was finished without measurement after that time.

[Evaluation of Oxidation Stability (Lifetime)]

Based on the "residual percentage of RPVOT value" after each time, the lifetime of the lubricating oil composition was evaluated according to the following criteria. The results are shown in Table 1 and Table 2.

A: The residual percentage of RPVOT value after 192 hours was 25% or more.

B: The residual percentage of RPVOT value after 168 hours was 25% or more, but the residual percentage of RPVOT value after 192 hours was less than 25%.

C: The residual percentage of RPVOT value after 168 hours was less than 25%.

[Evaluation of Sludge Preventing Effect]

Lubricating oil compositions that had passed the oxidation stability test (Dry-TOST) up to 192 hours were targeted, and based on the "sludge formation amount after 168 hours and 192 hours" mentioned above, the sludge preventing effect of the lubricating oil composition was evaluated according to the following criteria. The results are shown in Table 1 and Table 2.

A: The sludge formation amount after 168 hours and after 192 hours was both less than 2.0 mg/100 ml.

B: The sludge formation amount after 168 hours was less than 2.0 mg/100 ml, but the sludge formation amount after 192 hours was 2.0 mg/100 ml or more.

C: The sludge formation amount after 168 hours and after 192 hours was both 2.0 mg/100 ml or more.

TABLE 1

| | | | Example 1 | Example 2 | Comparative Example 1 | Comparative Example 2 | Comparative Example 3 | Comparative Example 4 | Comparative Example 5 |
|---|---|---|---|---|---|---|---|---|---|
| Lubricating Oil Composition | | | (X1) | (X2) | (Y1) | (Y2) | (Y3) | (Y4) | (Y5) |
| Base Oil | Base Oil (A) | % by mass | 98.93 | 98.70 | 98.96 | 98.93 | 98.93 | 98.88 | 98.73 |
| Amine-Based Antioxidant | Component (B1) | % by mass | 0.03 | 0.03 | — | 0.03 | 0.32 | — | — |
| | Component (B2)-i | % by mass | 0.32 | 0.60 | 0.32 | 0.20 | 0.03 | — | 0.60 |
| | Component (B2)-ii | % by mass | — | — | — | — | — | 0.40 | — |
| | Component (B3)-i | % by mass | 0.20 | — | 0.20 | 0.32 | 0.20 | 0.20 | — |
| | Component (B3)-ii | % by mass | — | 0.10 | — | — | — | — | 0.10 |
| Various Additives | Extreme-Pressure Agent | % by mass | 0.40 | 0.40 | 0.40 | 0.40 | 0.40 | 0.40 | 0.40 |
| | Rust Inhibitor | % by mass | 0.05 | 0.05 | 0.05 | 0.05 | 0.05 | 0.05 | 0.05 |
| | Copper Deactivator | % by mass | 0.02 | 0.02 | 0.02 | 0.02 | 0.02 | 0.02 | 0.02 |
| | Anti-Foaming Agent | % by mass | 0.05 | 0.10 | 0.05 | 0.05 | 0.05 | 0.05 | 0.10 |
| Total | | % by mass | 100.00 | 100.00 | 100.00 | 100.00 | 100.00 | 100.00 | 100.00 |
| Content of Amine-Based Antioxidant in Lubricating Oil Composition | | % by mass | 0.55 | 0.73 | 0.52 | 0.55 | 0.55 | 0.60 | 0.70 |
| Content of Component (B1) in Amine-Based Antioxidant *1 | | % by mass | 5.4 | 4.1 | 0.0 | 5.4 | 58.2 | 0.0 | 0.0 |
| Content of Component (B2) in Amine-Based Antioxidant *1 | | % by mass | 58.2 | 82.2 | 61.5 | 36.4 | 5.4 | 66.7 | 85.7 |
| Content of Component (B3) in Amine-Based Antioxidant *1 | | % by mass | 36.4 | 13.7 | 38.5 | 58.2 | 36.4 | 33.3 | 14.3 |
| Content Ratio of Component (B1) relative to 100 parts by mass of component (B2) | | part by mass | 9.4 | 5.0 | 0.0 | 15.0 | 1066.7 | 0.0 | 0.0 |
| Content Ratio of Component (B3) relative to 100 parts by mass of component (B2) | | part by mass | 62.5 | 16.7 | 62.5 | 160.0 | 666.7 | 50.0 | 16.7 |
| Kinematic Viscosity at 40° C. of Lubricating Oil Composition | | $mm^2/s$ | 31.47 | 31.78 | 31.50 | 31.28 | 31.15 | 31.48 | 31.78 |
| Viscosity Index of Lubricating Oil Composition | | — | 124 | 125 | 124 | 125 | 125 | 125 | 124 |

TABLE 1-continued

| | | | Example 1 | Example 2 | Comparative Example 1 | Comparative Example 2 | Comparative Example 3 | Comparative Example 4 | Comparative Example 5 |
|---|---|---|---|---|---|---|---|---|---|
| RPVOT | Initial RPVOT Value (150° C., 620 kPa) | min | 2585 | 2751 | 2372 | 2469 | 4885 | 2220 | 1517 |
| Dry-TOST 150° C., 168 h | Sludge Formation Amount | mg/100 ml | 1.2 | 1.6 | 0.8 | 1.2 | 2.3 | 2.0 | * |
| | RPVOT Value (150° C., 620 kPa) | min | 994 | 1050 | 741 | 851 | 2695 | 615 | 18 |
| | Residual Percentage of RPVOT Value | % | 38.5 | 38.2 | 31.2 | 34.5 | 55.2 | 27.7 | 1.2 |
| Dry-TOST 150° C., 192 h | Sludge Formation Amount | mg/100 ml | 1.1 | 0.9 | 1.1 | 9.2 | 5.2 | 2.0 | — |
| | RPVOT Value (150° C., 620 kPa) | min | 767 | 762 | 516 | 14 | 2058 | 396 | — |
| | Residual Percentage of RPVOT Value | % | 29.7 | 27.7 | 21.8 | 0.6 | 42.1 | 17.8 | — |
| Dry-TOST 150° C., 216 h | Sludge Formation Amount | mg/100 ml | 1.8 | 3.1 | — | — | 11.0 | — | — |
| | RPVOT Value (150° C., 620 kPa) | min | 348 | 423 | — | — | 1619 | — | — |
| | Residual Percentage of RPVOT Value | % | 13.5 | 15.4 | — | — | 33.1 | — | — |
| Evaluation | Oxidation Stability (Lifetime) | — | A | A | B | B | A | B | C |
| | Sludge Preventing Effect | — | A | A | A | B | C | C | — |

*1 Content ratio based on 100% by mass of the total amount of the amine-based antioxidant.

* Unmeasurable

TABLE 2

| | | | Comparative Example 6 | Comparative Example 7 | Comparative Example 8 | Comparative Example 9 | Comparative Example 10 | Comparative Example 11 |
|---|---|---|---|---|---|---|---|---|
| Lubricating Oil Composition | | | (Y6) | (Y7) | (Y8) | (Y9) | (Y10) | (Y11) |
| Base Oil | Base Oil (A) | % by mass | 98.70 | 98.70 | 99.08 | 98.93 | 98.65 | 98.38 |
| Amine-Based Antioxidant | Component (B1) | % by mass | 0.03 | 0.60 | — | — | — | — |
| | Component (B2)-i | % by mass | 0.10 | 0.03 | 0.25 | — | — | — |
| | Component (B2)-ii | % by mass | — | — | — | 0.45 | 0.53 | 0.80 |
| | Component (B3)-i | % by mass | — | — | — | — | — | — |
| | Component (B3)-ii | % by mass | 0.60 | 0.10 | 0.10 | 0.10 | 0.30 | 0.30 |
| Various Additives | Extreme-Pressure Agent | % by mass | 0.40 | 0.40 | 0.40 | 0.40 | 0.40 | 0.40 |
| | Rust Inhibitor | % by mass | 0.05 | 0.05 | 0.05 | 0.05 | 0.05 | 0.05 |
| | Copper Deactivator | % by mass | 0.02 | 0.02 | 0.02 | 0.02 | 0.02 | 0.02 |
| | Anti-Foaming Agent | % by mass | 0.10 | 0.10 | 0.10 | 0.05 | 0.05 | 0.05 |
| Total | | % by mass | 100.00 | 100.00 | 100.00 | 100.00 | 100.00 | 100.00 |
| Content of Amine-Based Antioxidant in Lubricating Oil Composition | | % by mass | 0.73 | 0.73 | 0.35 | 0.55 | 0.83 | 1.10 |
| Content of Component (B1) in Amine-Based Antioxidant *1 | | % by mass | 4.1 | 82.2 | 0.0 | 0.0 | 0.0 | 0.0 |
| Content of Component (B2) in Amine-Based Antioxidant *1 | | % by mass | 13.7 | 4.1 | 71.4 | 81.8 | 63.9 | 72.7 |
| Content of Component (B3) in Amine-Based Antioxidant *1 | | % by mass | 82.2 | 13.7 | 28.6 | 18.2 | 36.1 | 27.3 |
| Content Ratio of Component (B1) relative to 100 parts by mass of component (B2) | | part by mass | 30.0 | 2000.0 | 0.0 | 0.0 | 0.0 | 0.0 |
| Content Ratio of Component (B3) relative to 100 parts by mass of component (B2) | | part by mass | 600.0 | 333.3 | 40.0 | 22.2 | 56.6 | 37.5 |
| Kinematic Viscosity at 40° C. of Lubricating Oil Composition | | $mm^2/s$ | 31.85 | 31.27 | 31.74 | 31.37 | 31.36 | 31.40 |
| Viscosity Index of Lubricating Oil Composition | | — | 124 | 124 | 125 | 125 | 124 | 123 |
| RPVOT | Initial RPVOT Value (150° C., 620 kPa) | min | 1725 | 7731 | 2126 | 2350 | 2505 | 3127 |
| Dry-TOST 150° C., 168 h | Sludge Formation Amount | mg/100 ml | * | 74.0 | 0.5 | 0.7 | 1.2 | 1.4 |
| | RPVOT Value (150° C., 620 kPa) | min | 18 | 4693 | 611 | 582 | 582 | 1070 |
| | Residual Percentage of RPVOT Value | % | 1.0 | 60.7 | 28.7 | 24.8 | 23.2 | 34.2 |

TABLE 2-continued

| | | | Comparative Example 6 | Comparative Example 7 | Comparative Example 8 | Comparative Example 9 | Comparative Example 10 | Comparative Example 11 |
|---|---|---|---|---|---|---|---|---|
| Dry-TOST 150° C., 192 h | Sludge Formation Amount | mg/100 ml | — | 60.0 | 3.4 | — | — | 3.9 |
| | RPVOT Value (150° C., 620 kPa) | min | — | 4570 | 15 | — | — | 707 |
| | Residual Percentage of RPVOT Value | % | — | 59.1 | 0.7 | — | — | 22.6 |
| Dry-TOST 150° C., 216 h | Sludge Formation Amount | mg/100 ml | — | 150.0 | — | — | — | — |
| | RPVOT Value (150° C., 620 kPa) | min | — | 2169 | — | — | — | — |
| | Residual Percentage of RPVOT Value | % | — | 28.1 | — | — | — | — |
| Evaluation | Oxidation Stability (Lifetime) | — | C | A | B | C | C | B |
| | Sludge Preventing Effect | — | — | C | B | — | — | B |

*1 Content ratio based on 100% by mass of the total amount of the amine-based antioxidant.
* Unmeasurable The result is that the lubricating oil compositions (X1) and (X2) prepared in Examples 1 and 2 had excellent oxidation stability and sludge preventing effect.

On the other hand, the result is that the lubricating oil compositions (Y1) to (Y2), (Y4) to (Y6) and (Y8) to (Y11) prepared in Comparative Examples had a low residual percentage of RPVOT value and were poor in oxidation stability.

The lubricating oil compositions (Y3) and (Y7) prepared in Comparative Examples 3 and 7 had a high residual percentage of RPVOT value, but had a large sludge formation amount, and the result is that these compositions were poor in the sludge preventing effect.

INDUSTRIAL APPLICABILITY

The lubricating oil composition of the present invention maintains excellent oxidation stability even in long-term use in high-temperature environments, and has an excellent lifetime and is excellent also in a sludge preventing effect.

Consequently, the lubricating oil composition of one embodiment of the present invention can be favorably used, for example, as turbine oils, compressor oils, hydraulic oils, etc.

The invention claimed is:

1. A lubricating oil composition, comprising a base oil (A), wherein said base oil (A) is a mineral oil and wherein the content of the base oil (A) is 80% by mass or more based on the total amount of the lubricating oil composition, optionally, an alkylbenzene, and an amine-based antioxidant (B), wherein the content of the component (B) is from 0.30 to 1.0% by mass based on the total amount of the lubricating oil composition, and wherein:

the component (B) comprises a phenyl-naphthylamine (B1) of the formula (b1-1), an alkylphenyl-naphthylamine (B2) of the formula (b2-2), and a di(alkylphenyl)amine (B3) of the formula (b3-2);

the content of the component (B1) is from 2.0 to 10.0% by mass relative to 100% by mass of the total amount of the component (B);

the content of the component (B2) is from 58.2 to 82.2% by mass relative to 100% by mass of the total amount of the component (B); and the content of the component (B3) is from 13.7 to 36.4% by mass relative to 100% by mass of the total amount of the component (B), wherein the content of the component (B2) is greater than the content of the component (B3), wherein the content of the component (B3) is greater than the content of the component (B1), wherein the total amount of component (B1), component (B2), and component (B3) is from 95 to 100% by mass of the total amount of the component (B), wherein the content of the component (B3) is from 16.7 to 62.5 parts by mass relative to 100 parts by mass of the total amount of the component (B2);

when the lubricating oil composition is tested according to the oxidation stability test (Dry-TOST method) of ASTM D7873, the time to be taken until the residual percentage of RPVOT value measured according to ASTM D2272 reaches less than 25% is 192 hours or more; and when the lubricating oil composition is tested according to the oxidation stability test (Dry-TOST method) of ASTM D7873, the sludge formation amount after 192 hours from the start of the test is less than 2.0 mg/100 ml:

(b1-1)

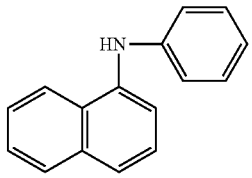

(b2-2)

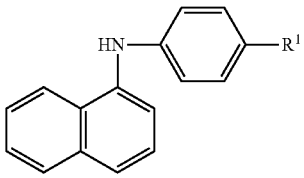

-continued (b3-2)

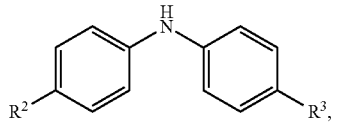

wherein $R^1$ to $R^3$ each independently represent an alkyl group.

2. The lubricating oil composition according to claim 1, wherein the content of the component (B1) is from 2.5 to 20 parts by mass relative to 100 parts by mass of the total amount of the component (B2).

3. The lubricating oil composition according to claim 1, wherein $R^1$ to $R^3$ each independently contain from 1 to 20 carbon atoms.

4. The lubricating oil composition according to claim 1, wherein a content of a sulfur atom-containing compound is less than 10 parts by mass relative to 100 parts by mass of the total amount of the component (B).

5. The lubricating oil composition according to claim 1, wherein a content of a metal-based antioxidant is 0 parts by mass relative to 100 parts by mass of the total amount of the component (B).

6. The lubricating oil composition according to claim 1, wherein a content of an antioxidant (C) other than the component (B) is 0 parts by mass relative to 100 parts by mass of the total amount of the component (B).

7. The lubricating oil composition according to claim 1, further comprising one or more additives for a lubricating oil selected from the group consisting of an extreme-pressure agent, a detergent dispersant, a viscosity index improver, a rust inhibitor, a metal deactivator, an anti-foaming agent, a friction modifier, and an anti-wear agent.

8. The lubricating oil composition according to claim 1, further comprising a phosphorus-based extreme-pressure agent, wherein the content of the phosphorus-based extreme-pressure agent is from 0.01 to 10% by mass based on the total amount of the lubricating oil composition.

9. The lubricating oil composition according to claim 8, wherein the phosphorus-based extreme-pressure agent is a phosphate ester (1) represented by the following general formula (p-1):

(p-1)

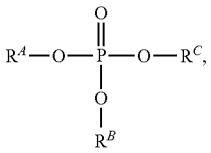

wherein $R^A$ to $R^C$ each independently represent an alkyl group or a substituted or unsubstituted aryl group.

10. The lubricating oil composition according to claim 8, wherein the content of the phosphorus-based extreme-pressure agent is 10 to 150 parts by mass relative to 100 parts by mass of the total amount of the component (B).

11. The lubricating oil composition according to claim 1, wherein:

the content of the component (B1) is from 3.5 to 6.5% by mass relative to 100% by mass of the total amount of the component (B).

12. The lubricating oil composition according to claim 1, wherein the alkylbenzene is present.

* * * * *